US007420537B2

(12) United States Patent
Wang et al.

(10) Patent No.: US 7,420,537 B2
(45) Date of Patent: Sep. 2, 2008

(54) LIQUID CRYSTAL DISPLAY AND DUMMY LOADING DEVICE THEREOF

(75) Inventors: Wei Wang, Hualien (TW); Ya-Hsiang Tai, Hsinchu (TW)

(73) Assignee: TPO Displays Corp., Miao-Li County (TW)

( * ) Notice: Subject to any disclaimer, the term of this patent is extended or adjusted under 35 U.S.C. 154(b) by 534 days.

(21) Appl. No.: 11/050,576

(22) Filed: Feb. 4, 2005

(65) Prior Publication Data

US 2005/0190134 A1 Sep. 1, 2005

(30) Foreign Application Priority Data

Feb. 26, 2004 (TW) ..... 93104886 A

(51) Int. Cl.
*G09G 3/36* (2006.01)

(52) U.S. Cl. ..... 345/100; 345/87; 345/98

(58) Field of Classification Search ..... 345/55, 345/84, 87, 98, 100
See application file for complete search history.

(56) References Cited

U.S. PATENT DOCUMENTS 6,204,895 B1 * 3/2001 Nakamura et al. ..... 349/5
2003/0193465 A1 * 10/2003 Ohkawa et al. ..... 345/100

FOREIGN PATENT DOCUMENTS

JP 2002091388 3/2002

* cited by examiner

*Primary Examiner*—My-Chau T Tran
(74) *Attorney, Agent, or Firm*—MH2 Technology Law Group LLP

(57) ABSTRACT

A liquid crystal display and a dummy-loading device thereof are provided. The dummy-loading device is suitable for a liquid crystal display having a plurality of pixel bands. The liquid crystal display comprises an input signal line to receive image data, and a plurality of horizontal switches and a plurality of shift registers connected in series. The shift registers sequentially shift and output a video control signal for conducting the input signal lines and the pixel bands. A dummy-loading device is disposed in the liquid crystal display, comprising a dummy pixel band, a dummy shift register and a dummy horizontal switch on one side of the liquid crystal display, for providing the edge band compensation to resolve unbalanced imaging.

13 Claims, 5 Drawing Sheets

LIQUID CRYSTAL DISPLAY AND DUMMY LOADING DEVICE THEREOF

CROSS-REFERENCE TO RELATED APPLICATION

This application claims the priority benefit of Taiwan application serial no. 93104886, filed on Feb. 26, 2004.

BACKGROUND OF THE INVENTION

1. Field of Invention

The present invention relates to a liquid crystal display and a dummy-loading device thereof. More particularly, the present invention relates to a dummy-loading device capable of providing edge band compensation and resolving unbalanced imaging of the liquid crystal display.

2. Description of the Related Art

Generally speaking, a liquid crystal display (LCD) can be roughly categorized into a passive matrix LCD and an active matrix LCD according to the driving method. A typical application for passive matrix LCDs are portable telephones. However, due to a relatively severe capacitor coupling effect, images produced by the passive matrix LCD device suffer from low quality, such as receding images, low contrast, slow response, etc. Moreover, passive matrix LCDs are generally driven by multiplexers, making their implementation more complicated as compared to active matrix LCDs. Accordingly, it is difficult for a passive matrix LCD to produce images with high resolution, high image quality, and full color. However, passive matrix LCDs are relatively inexpensive to produce. As such, they are used in low-end display apparatus.

On the other hand, laptop computers (notebook computers) or the monitors used in precision-made instruments, usually apply a thin-film-transistor LCD (TFT-LCD), an active matrix liquid crystal display. The active matrix LCD is an improvement over the passive matrix LCD, with better image quality and higher resolution, made possible by a drive array utilized to control the spinning of liquid crystal molecules.

FIG. 1 shows a schematic diagram of a drive array in a TFT-LCD. The drive array comprises a plurality of source lines 112~118 (or data lines) for driving video data, a plurality of gate lines 132~138 (or scan lines), a plurality of TFTs 152~168, a plurality of liquid crystal capacitors 181~197, and a coupling capacitance (not shown). A brief description of how much electric potential is applied to a liquid crystal molecule of each pixel in an LCD is given herein. In an active matrix LCD each pixel is controlled by one to four TFTs. In FIG. 1, a pixel is controlled by one TFT. The gates of the TFTs 152~168 are connected in horizontal gate lines 132~138, and the sources of the TFTs 152~168 are connected in vertical source lines 112~118, and the drains of the TFTs 152~168 are connected to pixel electrodes. It should be noted that, in practical applications, the sources and the drains can be, but are not limited to being, connected to the data lines and the pixel electrodes, respectively. Also, the electric potential applied to electrodes of TFTs 152~168 is not necessarily set at a constant value.

The operating method of a TFT is described in the following. First, a gate line is activated, such as gate line 132, to turn on all the TFTs 152~156 of gate line 132. The desired video data to be displayed are inputted via the source lines 112~118. The electrodes are charged to the electric potential corresponding to the video data. Next, the TFTs 152~156 are turned off until the next video data is inputted, while the electric charges are preserved in the liquid crystal capacitors 181~185. Thereafter, a next gate line is turned on, such as gate line 134, and desired video data are inputted. After the video data of a full image are inputted sequentially, the next image will be displayed starting from the first gate line. Because this driving method is quite simple, the interaction among pixels is substantially reduced. Also, the image quality of the LCDs can depend on the electrical characteristics of the TFTs. In this way, the cut-off current, the driving current, the parasitic capacitance, and the switching rate for the TFTs can determine the image quality of an LCD.

FIG. 2 schematically illustrates a conventional source driving circuit. The source driving circuit comprises a plurality of shift registers $SR_1$~$SR_n$ and a plurality of horizontal switches $HSW_1$~$HSW_n$ for driving a plurality of pixel bands $B_1$~$B_n$ in an active area. As shown in FIG. 2, the sequential operation diagram of the video control signals is outputted from the shift registers $SR_1$~$SR_n$. When the horizontal switches $HSW_1$ and $HSW_2$ are turned on, the video data are transferred to the pixel band $B_1$. Accordingly, when video data of the $1^{st}$~$(n-1)^{th}$ pixel bands $B_1$~$B_{n-1}$ are written in the active area, two horizontal switches are turned on simultaneously, equal to the loading effect of two pixels. When the video data of the last pixel band $B_n$ are written, merely one horizontal switch $HSW_n$ is turned on, equal to the loading effect of one pixel. Different loading results in different electric potential of pixels and coupling capacitance. Consequently, in the prior art, when the last video data are transmitted, different loading leads to unbalanced imaging.

SUMMARY OF THE INVENTION

According to various embodiments, there is provided a liquid crystal display and a dummy loading device thereof, for resolving unbalanced imaging resulting from different loading.

According to various embodiments, there is also provided an electronic device comprising a liquid crystal display and an input device.

According to various embodiments, there is also provided a liquid crystal display, comprising an active area, input signal lines, a plurality of shift registers, a plurality of horizontal switches, a dummy pixel band, a dummy shift register, and a dummy horizontal switch. According to various embodiments, the active area comprises a plurality of pixel bands for displaying images. The input signal lines are used to input image data to the active area. A plurality of shift registers connected in series are used to sequentially output a video control signal. Each horizontal switch is coupled to the corresponding shift register and pixel band to receive the video control signal for conducting the input signal lines and the pixel bands. The image data are thus provided to the pixel bands mentioned above. The dummy shift register is electrically coupled to one terminal of the shift register to sequentially shift and output the video control signal. The dummy horizontal switch is electrically coupled between the dummy pixel band and the dummy shift register for conducting the input signal line and the dummy pixel band according to the video control signal.

According to various embodiments, there is also provided a dummy loading device suitable for a liquid crystal display. The liquid crystal display can comprise an active area having a plurality of pixel bands, an input signal line, a plurality of horizontal switches, and a plurality of shift registers. According to various embodiments, the shift registers are coupled in series to sequentially shift and output a video control signal. The horizontal switches are controlled by the video control signal for conducting and/or controlling the input signal lines and the pixel bands. The dummy loading device comprises a dummy pixel band, a dummy shift register, and a dummy horizontal switch. The dummy shift register can be electrically coupled to one terminal of the serially connected shift registers to sequentially output the video control signal. The dummy horizontal switch is electrically coupled between the dummy pixel band and the dummy shift register for conducting the input signal line and the dummy pixel band according to the video control signal. According to various embodiments, the dummy loading provided by the dummy loading device is utilized to achieve edge band compensation effect, and consequently reduce the unbalanced imaging in the edge band.

DESCRIPTION OF THE EMBODIMENTS

In order to resolve the problem of aforementioned unbalanced imaging, the dummy pixel band comprising dummy pixels can be disposed outside the normal displaying area, such as outside of the active area of the liquid crystal display. By controlling the dummy horizontal switch, the loading of the $n^{th}$ pixel band $B_n$ and that of the $1^{st}$~$(n-1)^{th}$ pixel band $B_1$~$B_{n-1}$ are the same.

Figure 1:
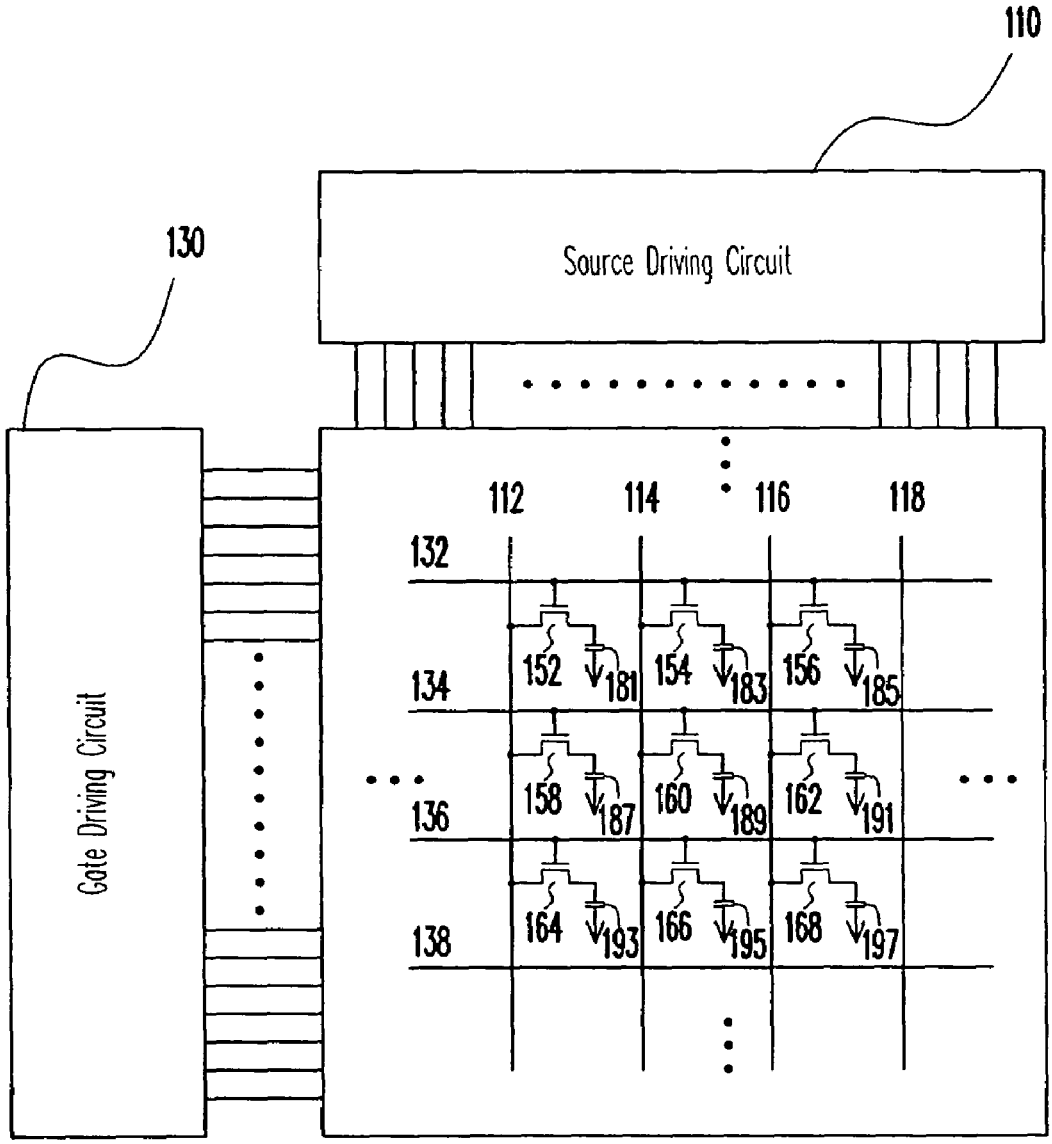
FIG. 1 (PRIOR ART)
FIG. 1 schematically shows a conventional drive array of a thin film transistor liquid crystal display.
Figure 2:
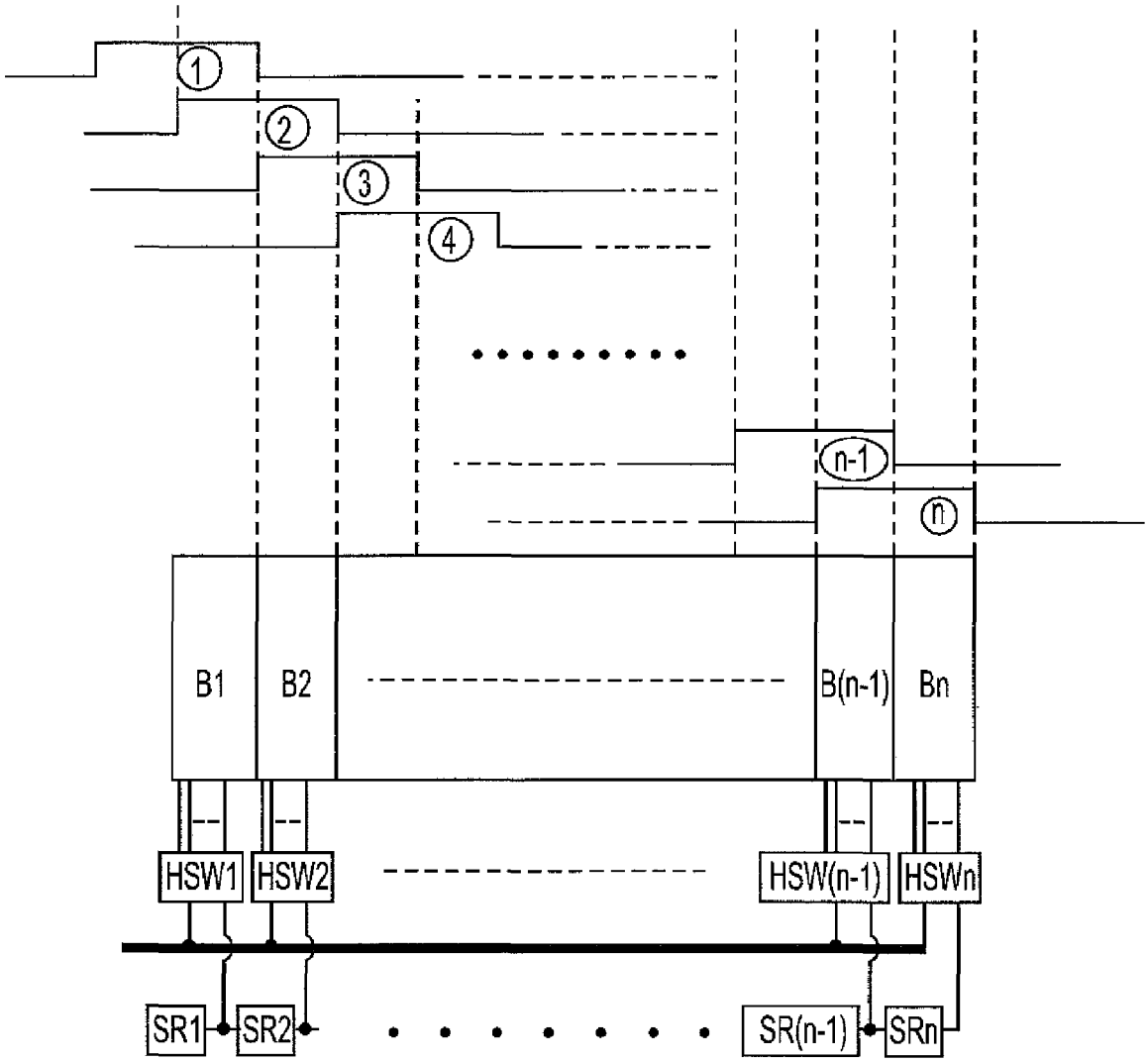
FIG. 2 (PRIOR ART)
FIG. 2 schematically shows a conventional source driving circuit.
Figure 3:
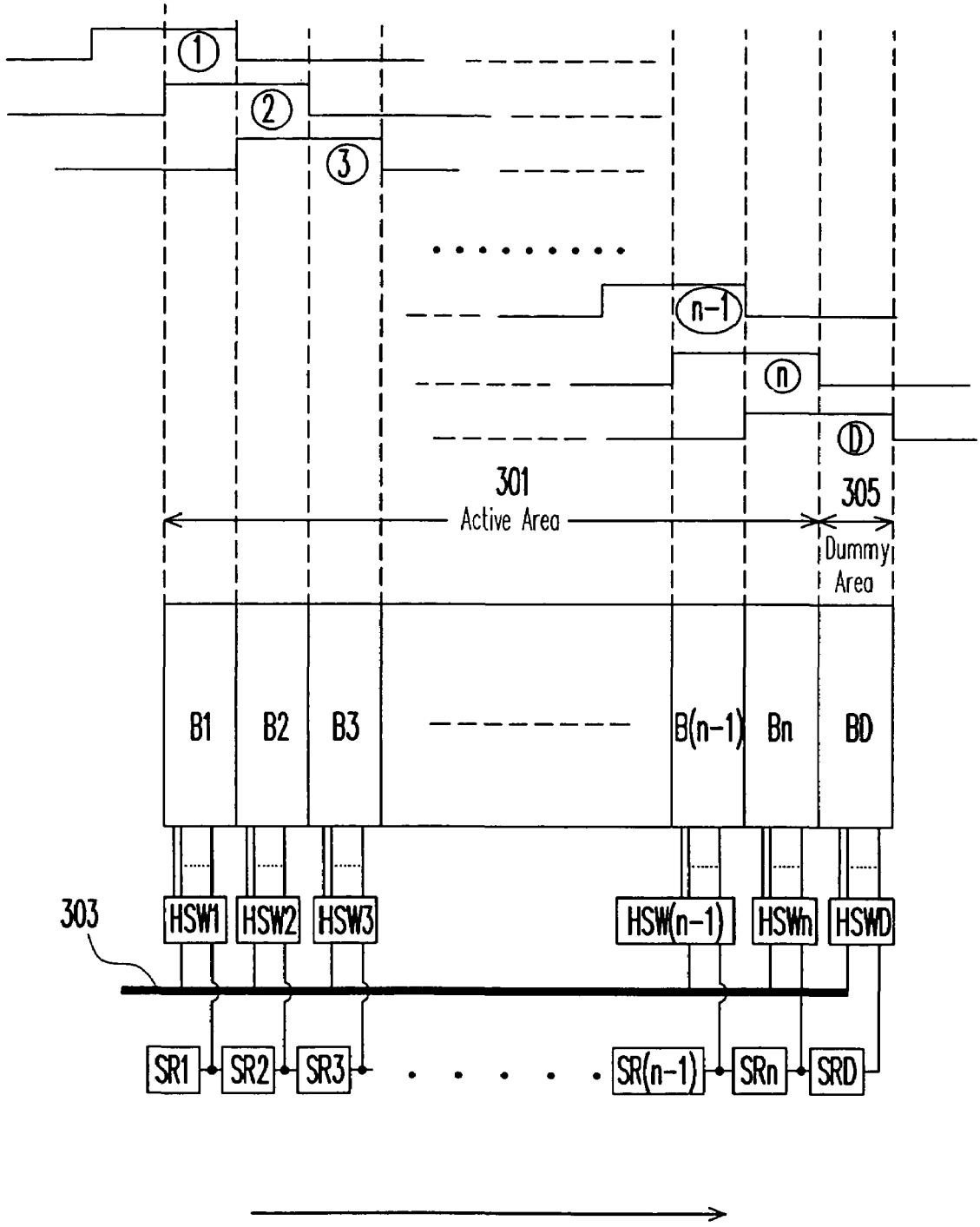
FIG. 3 schematically shows a circuit diagram of a liquid crystal display according to an embodiment of the present invention.

FIG. 3 schematically shows a circuit diagram of a liquid crystal display circuit according to an embodiment of the present invention. As shown, the liquid crystal display with a dummy loading device comprises an active area 301, an input signal line 303, a plurality of pixel bands $B_1$~$B_n$, a plurality of shift registers $SR_1$~$SR_n$, a plurality of horizontal switches $HSW_1$~$HSW_n$, a dummy area 305, a dummy pixel band BD, a dummy shift register SRD, and a dummy horizontal switch HSWD. According to various embodiments, the active area 301 comprises a plurality of pixel bands $B_1$~$B_n$, starting from the first pixel band $B_1$ to the $n^{th}$ pixel band $B_n$, for displaying images. The input signal line 303 is used to input image data to the active area 301. A plurality of shift registers $SR_1$~$SR_n$ can be connected in series to sequentially output video control signals. Each of horizontal switches $HSW_1$~$HSW_n$ is coupled to the corresponding shift registers $SR_1$~$SR_n$ and the pixel bands $B_1$~$B_n$. For example, the horizontal switch $HSW_1$ is electrically coupled between the shift register $SR_1$ and the pixel band $B_1$. The horizontal switches $HSW_1$~$HSW_n$ are controlled by the video control signals to selectively conduct the input signal line 303 and the pixel bands B1~Bn, and thus the image data are transmitted to the pixel bands B1~Bn.

The dummy shift register SRD is electrically coupled to and is in series with one terminal of the shift register $SR_1$~$SR_n$ to sequentially shift and output the video control signal. For example, the dummy shift register SRD can be connected to shift register $SR_n$, to sequentially shift and output the video control signal to conduct the input signal line 303 and the dummy pixel band BD. The dummy horizontal switch HSWD can be electrically coupled between the dummy pixel band BD and the dummy shift register SRD, for conducting and/or controlling the input signal line 303 and the dummy pixel band BD according to the video control signal.

According to various embodiments, the dummy loading device is disposed in the dummy area 305, the device comprising a dummy pixel band BD, a dummy shifter register SRD, and a dummy horizontal switch HSWD. The operation method is as mentioned above. According to various embodiments, the dummy loading device can also comprise a logic switch device.

Figure 4:
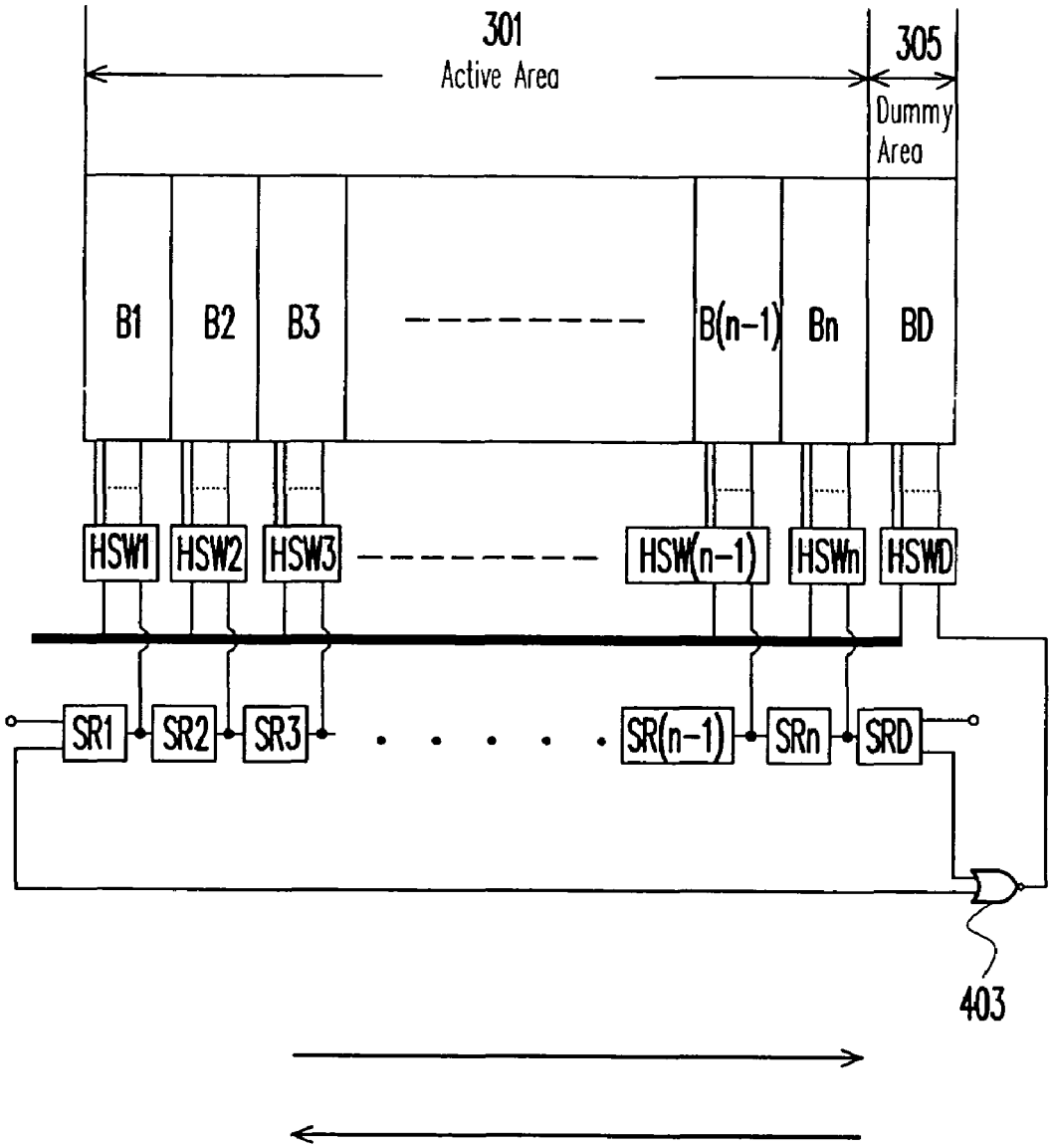
FIG. 4 schematically shows a circuit diagram of a liquid crystal display according to another embodiment of the present invention.

FIG. 4 shows a schematic circuit diagram of a liquid crystal display according to another embodiment of the present invention. In the embodiment, the logic switch device is a NOR gate 403, coupled between the shift register SR1 and the dummy shift register SRD. As such, the edge band compensation for the unbalanced imaging in the pixel bands B1 or BD can still be provided, such as when the sequentially shifting direction of the shift registers $SR_1$~$SR_n$ and that of the dummy shift registers SRD are changed.

Turning back to FIG. 3, according to various embodiments, two of the horizontal switches $HSW_1$~$HSW_n$ and the corresponding dummy horizontal switch HSWD can be turned on during the same time that image data are transmitted. For example, in FIG. 3 the horizontal switches $HSW_1$ and $HSW_2$ can be turned on simultaneously and the horizontal switch $HSW_2$ and $HSW_3$ can be turned on simultaneously while an image data is transmitted, and so on. As such, the horizontal switch $HSW_n$ and the dummy horizontal switch HSWD can be turned on during the same time while an image data is transmitted. For example, when an image is displayed from pixel band $B_1$ to pixel band $B_n$ in the active area 301, two of the horizontal switches are turned on during the same time while an image data is transmitted. Accordingly, the circuit loading is consistent, and the unbalanced imaging can be avoided. For example, the band edge effect can be compensated and unbalanced imaging in the band edge can be reduced.

In situations where layout space is limited such that dummy loading can not be achieved with pixels, various electronic loads, such as, for example, capacitors and resistors can be utilized to bear the loading so as to save space. The loading of the capacitances and resistances can be equal to that of each pixel band in the active area 301. According to various embodiments, each of the pixel bands can be N times of a pixel width. For example, a pixel band can be 24 times of a pixel in width. In this exemplary case where all the pixel bands are 24 pixels wide in the entire LCD, and where the resolution of the liquid crystal display is 640×480, the number of pixel bands in the active area 301 is 640×3/80=80. The multiple "3" here stands for the three primary colors. It is to be understood, however, that these values are exemplary only, and other values are contemplated.

Figure 5:
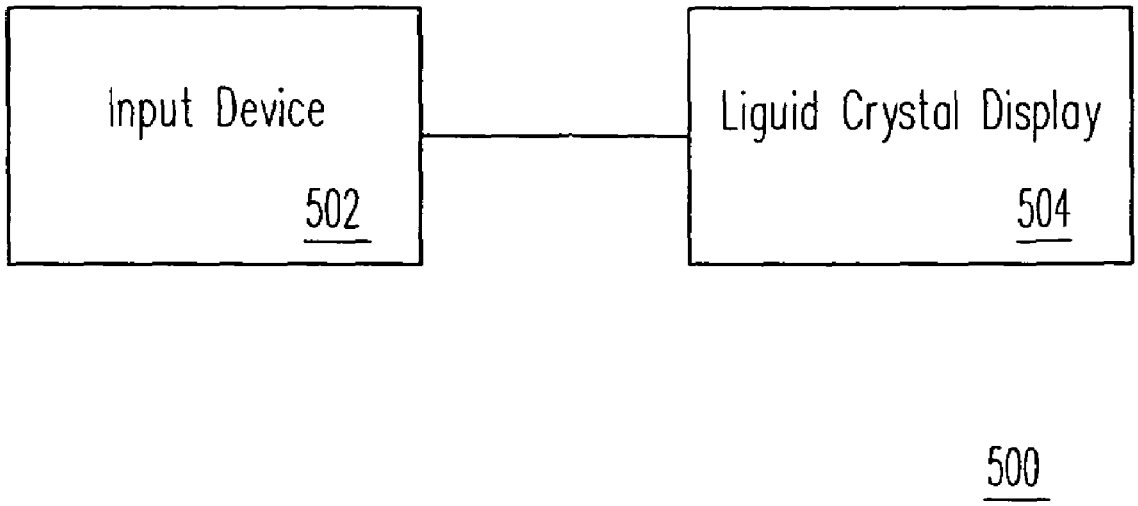
FIG. 5 schematically shows an electronic device according to another embodiment of the present invention.

FIG. 5 schematically shows an electronic device 500 according to another embodiment of the present invention. The electronic device 500 comprises an input device 502 and a liquid crystal display 504. According to various embodiments, the liquid crystal display 504 comprises an active area, an input signal line, a plurality of shifter registers $SR_1$~$SR_n$, a plurality of horizontal switches $HSW_1$~$HSW_n$, a dummy area, a dummy pixel band BD, a dummy shifter register SRD, and a dummy horizontal switch HSWD. The various components of the electronic device 500 can be similar to those described above.

Although the invention has been described with respect to a particular embodiment thereof, it will be apparent to those skilled in the art that modifications to the described embodiment may be made without departing from the spirit of the invention. Accordingly, the scope of the invention will be defined by the attached claims and not by the above detailed description.

What is claimed is:

1. A liquid crystal display, comprising:

an active area having a plurality of pixel bands for displaying an image;

an input signal line for inputting image data;

a plurality of shift registers coupled in series, for sequentially shifting and outputting a video control signal;

a plurality of horizontal switches, each of the horizontal switches being coupled to one corresponding shift registers and to one of the corresponding pixel bands and to conduct the input signal lines with the pixel bands based upon the video control signal, so as to provide the image data into the pixel bands;

a dummy pixel band;

a dummy shift register coupled to one terminal of the shift registers for sequentially shifting and outputting the video control signal;

a NOR gate logic switch device coupled to the dummy shift register and the shift registers; and a dummy horizontal switch coupled to the dummy pixel band and to the dummy shift register, for conducting the input signal line and the dummy pixel band according to the video control signal.

2. The liquid crystal display according to claim 1, wherein two of the horizontal switches and the corresponding dummy horizontal switches are turned on while an image data is transmitted.

3. The liquid crystal display according to claim 1, wherein the dummy pixel band comprises at least one electronic load selected from resistors and capacitors.

4. A dummy-loading device suitable for a liquid crystal display, wherein the liquid crystal display comprises an active area having a plurality of pixel bands, an input signal line, a plurality of horizontal switches and a plurality of shift registers, and the shift registers are connected in series for sequentially shifting and outputting a video control signal, the horizontal switches being controlled by the video control signal to conduct the input signal lines and the pixel bands, and the dummy loading device comprising:

a dummy pixel band;

a dummy shift register coupled to one terminal of the shift registers in series for sequentially shifting and outputting the video control signal;

a NOR gate logic switch device coupled to the dummy shift register and the shift registers; and a dummy horizontal switch coupled to the dummy pixel band and the dummy shift register so as to conduct the input signal line and the dummy pixel band according to the video control signal.

5. The dummy-loading device according to claim 4, wherein two of the horizontal switches and the dummy horizontal switches are turned on while an image data is transmitted.

6. The dummy-loading device according to claim 4, wherein the dummy pixel band comprises at least one electronic load selected from resistors and capacitors.

7. An electronic device, comprising:

an input device for providing image data; and a liquid crystal display, comprising:

an active area having a plurality of pixel bands for displaying an image;

an input signal line for inputting image data;

a plurality of shift registers coupled in series, for sequentially shifting and outputting a video control signal;

a plurality of horizontal switches, wherein each of the horizontal switches being coupled to one of the corresponding shift registers and one of the corresponding pixel bands so as to conduct the input signal lines and the pixel bands based upon the video control signal and thereby to provide the image data into the pixel bands;

a dummy pixel band along only one edge of the active area;

a dummy shift register coupled to one terminal of the shift registers for sequentially shifting and outputting the video control signal;

a NOR gate logic switch device coupled to the dummy shift register and the shift registers; and a dummy horizontal switch coupled to the dummy pixel band and the dummy shift register, for conducting the input signal line and the dummy pixel band according to the video control signal.

8. A liquid crystal display, comprising:

an active area having a plurality of pixel bands for displaying an image;

an input signal line for inputting image data;

a plurality of shift registers coupled in series, for sequentially shifting and outputting a video control signal;

a plurality of horizontal switches, each of the horizontal switches being coupled to one corresponding shift registers and to one of the corresponding pixel bands and to conduct the input signal lines with the pixel bands based upon the video control signal, so as to provide the image data into the pixel bands;

a dummy pixel band along only one edge of the active area;

a dummy shift register coupled to one terminal of the shift registers for sequentially shifting and outputting the video control signal;

a NOR gate logic switch device coupled to the dummy shift register and the shift registers; and a dummy horizontal switch coupled to the dummy pixel band and to the dummy shift register, for conducting the input signal line and the dummy pixel band according to the video control signal.

9. The liquid crystal display according to claim 8, wherein two of the horizontal switches and the corresponding dummy horizontal switches are turned on while an image data is transmitted.

10. The liquid crystal display according to claim 8, wherein the dummy pixel band comprises at least one electronic load selected from resistors and capacitors.

11. A dummy-loading device suitable for a liquid crystal display, wherein the liquid crystal display comprises an active area having a plurality of pixel bands, an input signal line, a plurality of horizontal switches and a plurality of shift registers, and the shift registers are connected in series for sequentially shifting and outputting a video control signal, the horizontal switches being controlled by the video control signal to conduct the input signal lines and the pixel bands, and the dummy loading device comprising:

a dummy pixel band along only one edge of the active area;

a dummy shift register coupled to one terminal of the shift registers in series for sequentially shifting and outputting the video control signal;

a NOR gate logic switch device coupled to the dummy shift register and the shift registers; and a dummy horizontal switch coupled to the dummy pixel band and the dummy shift register so as to conduct the input signal line and the dummy pixel band according to the video control signal.

12. The dummy-loading device according to claim 11, wherein two of the horizontal switches and the corresponding dummy horizontal switches are turned on while an image data is transmitted.

13. The dummy-loading device according to claim 11, wherein the dummy pixel band comprises at least one electronic load selected from resistors and capacitors.

* * * * *